US007285773B2

(12) United States Patent
Ding et al.

(10) Patent No.: US 7,285,773 B2
(45) Date of Patent: Oct. 23, 2007

(54) QUADRUPOLE ION TRAP DEVICE AND METHODS OF OPERATING A QUADRUPOLE ION TRAP DEVICE

(75) Inventors: Li Ding, Cheshire (GB); Michael Sudakov, Cheshire (GB)

(73) Assignee: Shimadzu Research Laboratory (GB)

( * ) Notice: Subject to any disclaimer, the term of this patent is extended or adjusted under 35 U.S.C. 154(b) by 561 days.

(21) Appl. No.: 10/494,493

(22) PCT Filed: Oct. 24, 2002

(86) PCT No.: PCT/GB02/04807

§ 371 (c)(1),
(2), (4) Date: Oct. 8, 2004

(87) PCT Pub. No.: WO03/041107

PCT Pub. Date: May 15, 2003

(65) Prior Publication Data

US 2005/0061966 A1 Mar. 24, 2005

(30) Foreign Application Priority Data

Nov. 5, 2001 (GB) ..... 0126525.5

(51) Int. Cl.
*H01J 49/42* (2006.01)

(52) U.S. Cl. ..... 250/282; 250/292; 250/290

(58) Field of Classification Search ..... None
See application file for complete search history.

(56) References Cited

U.S. PATENT DOCUMENTS

| | | | | |
|---|---|---|---|---|
| 4,540,884 | A | 9/1985 | Stafford et al. | |
| 4,736,101 | A | 4/1988 | Syka et al. | |
| 4,749,860 | A | 6/1988 | Kelley et al. | |
| 4,882,484 | A | 11/1989 | Franzen et al. | |
| 5,468,958 | A | 11/1995 | Franzen et al. | |
| 5,625,186 | A | 4/1997 | Frankevich et al. | |
| 6,069,355 | A | 5/2000 | Mordehai | |
| 6,965,106 | B2 * | 11/2005 | Ding et al. | 250/292 |
| 2007/0075239 | A1 * | 4/2007 | Ding et al. | 250/282 |

FOREIGN PATENT DOCUMENTS

| | | | |
|---|---|---|---|
| EP | 0863537 | A | 9/1998 |
| GB | 2280305 | A | 1/1995 |
| JP | 10208692 | A | 8/1998 |
| WO | WO01/29875 | A2 | 4/2001 |

OTHER PUBLICATIONS

J. Mitchell Wells, Wolfgang R. Plass, R. Graham Cooks, Control of Chemical Mass Shifts in the Quadrupole Ion Trap Through Selection of Resonance Ejection Working Point and rf Scan Direction, Analytical Chemistry, vol. 72, No. 13, Jul. 1, 2000, pp. 2677-2683.

* cited by examiner

*Primary Examiner*—Nikita Wells
(74) *Attorney, Agent, or Firm*—Duft Bornsen & Fishman, LLP

(57) ABSTRACT

A quadrupole ion trap device has a field adjusting electrode located outside the trapping region adjacent the aperture in the entrance end cap electrode, and optionally adjacent the aperture in the exit end cap electrode. The field adjusting electrode(s) controls field distortion in the vicinity of the apertures. By appropriately setting the voltages on the field adjusting electrodes the efficiency and resolution of operational processes such as ion introduction, precursor ion isolation and mass scanning can be improved.

30 Claims, 9 Drawing Sheets

QUADRUPOLE ION TRAP DEVICE AND METHODS OF OPERATING A QUADRUPOLE ION TRAP DEVICE

RELATED APPLICATIONS

This application is the National Stage of International Application No. PCT/GB02/04807, filed Oct. 24, 2002, entitled A QUADRUPOLE ION TRAP DEVICE AND METHODS OF OPERATING A QUADRUPOLE ION TRAP DEVICE, which claims priority benefit of United Kingdom (GB) Application No. 0126525.5, filed Nov. 5, 2001. This U.S. National Stage Application also claims priority benefit of United Kingdom (GB) Application No. 0126525.5, filed Nov. 5, 2001.

FIELD OF THE INVENTION

This invention relates to quadrupole mass spectrometry. In particular, the invention relates to a quadrupole ion trap device and methods of operating a quadrupole ion trap device.

BACKGROUND OF THE INVENTION

The quadrupole ion trap has been developed and, used in practice, as a mass spectrometer since the mass selective instability mode was invented several decades ago. This technique is described in U.S. Pat. No. 4,540,884. Later, in a series of the US patents such as those numbered U.S. Pat. Nos. 4,736,101, 4,749,860, 4,882,484, methods of MS and MS/MS employing resonance ejection of ions from the ion trap have been disclosed. Based on these methods, commercial ion trap mass spectrometer instruments have been manufactured and widely used The principle of operation of these instruments can be summarised by the following operational steps: Simultaneously trap the ions with a predefined mass range by applying a trapping RF voltage to the ion trap; apply supplementary AC voltage between the two end cap electrodes to cause resonance ejection of unwanted ions and again, use the supplementary AC voltage to activiate the remaining precursor ions to cause their collisional dissociation and produce product ions; and finally, scan one parameter of the trapping RF voltage or supplementary AC voltage to cause resonance ejection of ions sequentially in the order of their mass-to-charge ratios. Thus, by measuring the ejected ion current a mass spectrum can be obtained.

As the technology has developed, performance has been improved by adding high order multipole electric field components, in particular the octapole component to the quadrupole electric field. Technically, this was achieved by stretching the distance between the end caps of the ion trap or by decreasing the asymtotic cone angle of the hyperboloid geometry. These are permanent, structural changes that give rise to non-linear resonance of ion motion; so, these ion traps are also called non-linear ion traps. However, while the non-linear resonance which is caused by the high order multipole components brings about certain improvements in performance, such as good mass resolution at fast scan, it also introduces many problems. A quadrupole ion trap with significant high order multipole components cannot work in the mass-selective storage mode as is usual in the case of a quadrupole mass filter, because the non-linear resonance line which runs through the apex region of the well known (a-q) stability diagram causes ion loss. Furthermore, the non-linear ion trap cannot provide high resolution for precursor ion selection when the resonance ejection method is used.

U.S. Pat. No. 5,468,958 (Franzen and Wang) discloses a method for dividing each end cap electrode into component parts to allow the high order multipole part of the field to be selectively switched on or off. It is claimed that this kind of ion trap is able to store ions selectively with good resolution, and scan out the stored ions with good resolution as well. In practice, however, there is no easy way to implement such a device because both RF switching and precise tuning of coupling parameters are difficult to achieve. Also, no account is taken of the problem of field distortion near the end cap apertures.

Recent studies by G. Cooks published in Analytical Chemistry Vol. 72 No. 13, 2667, demonstrates that the end cap apertures where ions enter and exit the ion trap are the principal source of distortion in the quadrupole field. Such distortion causes chemical shift and delayed ejection which leads to poor resolution of mass analysis. Adding in a high order multipole field, as is done in some commercial instruments, can avoid the adverse effects of the aperture, giving improved analytical performance, but at the same time, introduces the afore-mentioned problems associated with high order multipole fields. The present inventors have discovered that by reducing field distortion in the vicinity of the aperture of an end cap electrode high mass resolution can be achieved without a significant high order multipole field. With an adjustable small high order field near the aperture there could be the opportunity to obtain even better results.

It is an object of the present invention to at least alleviate the afore-mentioned problems.

SUMMARY OF THE INVENTION

According to one aspect of this invention, there is provided a quadrupole ion trap device comprising an electrode structure having a ring electrode, and two end cap electrodes enclosing a trapping region, one said end cap electrode being an entrance end cap electrode having a central aperture through which ions can enter the trapping region, a field adjusting electrode located outside the trapping region adjacent to the aperture of said entrance end cap electrode, AC power supply means arranged to supply AC voltage to said electrode structure to create within the trapping region a trapping electric field for trapping ions and an excitation electric field for resonantly exciting ions trapped by the trapping electric field, and DC power supply means arranged to supply to said field adjusting electrode, and controllably vary, DC voltage whereby selectively to influence ion motion in the trapping region according to an operating mode of the ion trap device.

According to another aspect of the invention, there is provided a method of operating a quadrupole ion trap device including a ring electrode, and two end cap electrodes enclosing a trapping region one said end cap electrode being an entrance end cap electrode having a central aperture through which ions can enter the trapping region, and a field adjusting electrode located outside the trapping region adjacent to the aperture of said entrance end cap electrode, the method including, generating a trapping electric field within the trapping region, generating an excitation electric field within the trapping region for resonantly exciting ions trapped by the trapping electric field, applying DC voltage to said field adjusting electrode to influence ion motion near the entrance aperture, and selectively controlling the applied DC voltage to improve efficiency with which ions enter the trapping region through said entrance aperture and to enhance resolution of mass isolation carried out on the trapped ions.

BRIEF DESCRIPTION OF THE DRAWINGS

Embodiments of the invention are now described, by way of example only, with reference to the accompanying drawings, of which.

DETAILED DESCRIPTION OF THE PREFERRED EMBODIMENTS

Figure 1:
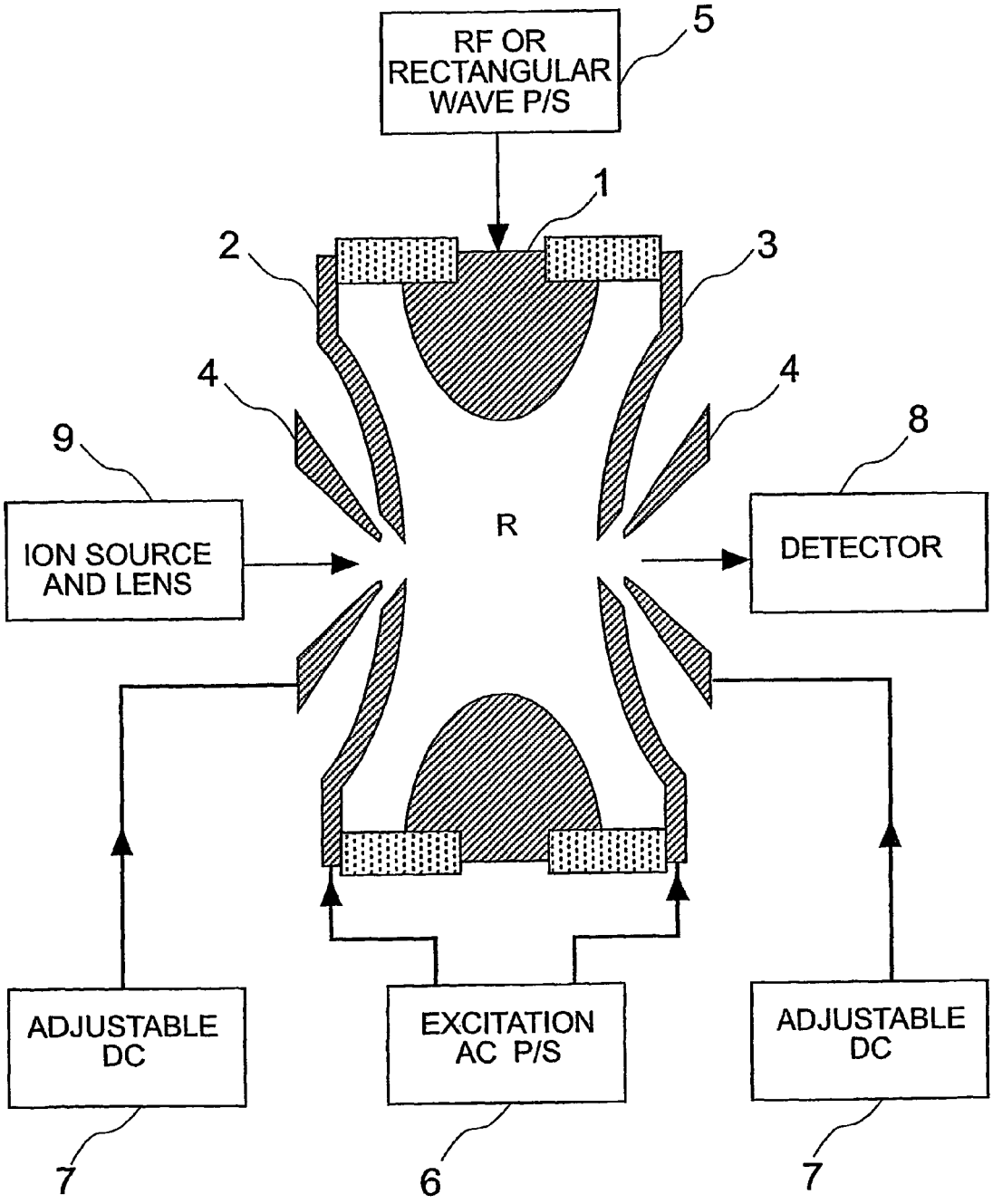
FIG. 1 is a block diagram showing a quadrupole ion trap device according to the invention, FIG. 2(*a*) shows an embodiment of a quadrupole ion trap device according to the invention having two field adjusting electrodes, one located adjacent to the entrance aperture and another located adjacent to the exit aperture, FIG. 2(*b*) shows another embodiment of a quadrupole ion trap device according to the invention having a single field adjusting electrode located adjacent the entrance aperture and a metal mesh covering the exit aperture.

Referring now to FIG. 1, the quadrupole ion trap device comprises a ring electrode 1, an entrance end cap electrode 2 having a central entrance aperture, and an exit end cap electrode 3 having a central exit aperture, and these components enclose the trapping region R of the ion trap device.

The device also includes a pair of field adjusting electrodes 4, located outside the trapping region. One of the field adjusting electrodes 4 is located adjacent to the entrance aperture of the entrance end cap electrode 2 and another field adjusting electrode 4 is located adjacent to the exit aperture of the exit end cap electrode 3, although this field adjusting electrode could optionally be omitted, as will be described later.

Ions produced in an ion source 9 are guided and focussed by conventional ion optics and are introduced into the trapping region R through an aperture in the field adjusting electrode 4 and then through the entrance aperture in the entrance end cap electrode 2. Ions exit the trapping region R through the exit aperture in the exit end cap electrode 3 and then through an aperture in the associated field adjusting electrode 4 (if present), and are detected by a detector 8.

A voltage source 5 supplies AC trapping voltage to the ring electrode 1 to generate a trapping electric field in the trapping region R. The trapping voltage may be a sinusoidal RF voltage with an optional DC component, but is preferably a rectangular waveform trapping voltage. In a preferred implementation, the rectangular waveform trapping voltage is generated digitally by controllably switching between high and low voltage levels to control the frequency and waveshape of the rectangular waveform voltage. Such control enables a parameter of the trapping voltage (e.g. frequency, amplitude) to be varied to facilitate certain operational functions, such as precursor ion isolation and mass scanning, as will be described later. The principle of such control has been disclosed in WO 01/29875.

A voltage source 6 supplies an AC excitation voltage to the end cap electrodes 2,3. The AC excitation voltage is used to create a dipole or quadrupole excitation electric field in the trapping region.

DC voltage sources 7 supply DC voltage to the field adjusting electrodes 4. As will be explained, the voltages supplied to the field adjusting electrodes are controllably adjustable to facilitate different operational modes of the device. In one implementation, the output of a voltage source 7 is controllably selectable from one of a number (e.g. 3) of different voltage levels depending on the mode of operation.

When the voltage on the field adjusting electrode 4 is set at certain value, negative for positive ions and positive for negative ions, ions in a certain range of mass-to-charge ratio can be simultaneously trapped in the trapping region R with the assistance of buffer gas. Ions can be scanned out of the trapping region by the well known technique of resonance ejection for detection by the detector 8. Scanning can be achieved by either ramping up the trapping voltage or by progressively reducing the frequency of the RF power supply or rectangular wave driver. Axial excitation for ion ejection can be achieved by dipole excitation and/or quadrupole excitation, both being well known prior art.

During resonance ejection (for a forward scanning process), the secular frequency $\omega_z$ of an ion of given mass-to-charge ratio (m/z) approaches along the q axis the excitation frequency $\omega_o$ corresponding to a resonance line in the (a-q) stability diagram having a value $\beta_z$, given by the expression $$\beta_z = \frac{2\omega_o}{\Omega}$$

where Ω is the angular frequency of the RF trapping voltage. As the amplitude of ion motion grows, ions start to feel the effect of the negative high order multipole field due to the aperture in the end cap electrode. The secular frequency of the ion is reduced and an ion which is supposed to be ejected loses its phase matching with the excitation field, and thus the oscillation amplitude decreases. The ejection process is therefore prolonged and poor mass resolution and chemical shift result.

However, the reduction of secular frequency near the aperture is now avoided by applying a certain DC voltage to the field adjusting electrode 4. It is even possible by applying extra DC voltage to increase the secular frequency causing phase matching with the excitation field, and so ejection of the ion, to occur faster.

Referring to the FIG. 2, two embodiments of field adjusting electrodes are shown. Whilst embodiment (a) employs two field adjusting electrodes 4, one behind each end cap electrode 2 and 3, embodiment (b) employs only one field adjusting electrode 4 behind the entrance aperture, and a fine mesh 10 covers the exit aperture. Both embodiments use electrode geometries that generate pure quadrupole electric field in the trapping region.

Now, a detailed example is given for analysing the resonance ejection process. Here the ion has a positive charge and the driving voltage is +/−1 kV and has a rectangular waveform which can be scanned by varying the trapping frequency $\Omega=2\pi f$, where f is the repetition rate of the waveform. Axial excitation is accomplished by applying a dipole rectangular wave voltage, generated by AC excitation source 6, between the two end cap electrodes 2, 3. For resonance at relatively large $\beta_z$ values (say $\beta_z>0.4$) an ion approaches the end cap apertures only during the negative phase of the trapping field at which time the ring electrode is charged at −1 kV. Here, $\beta_z$ is the value of a resonance line in the (a-q) stability diagram given by $$\beta_z = \frac{2\omega_o}{\Omega},$$

where $\omega_o$ is excitation frequency of the excitation electric field which, at resonance, is the same as the axial secular frequency $\omega_z$. In FIG. 2, when the field adjusting electrode (s) are supplied with 1.5 kV DC, the equipotential surfaces 11 do not show much field distortion near the apertures of the end cap electrodes 2,3. In this case, an ion can maintain its secular oscillation frequency until it hits an end cap electrode or exits the trapping region through one of the apertures. In fact, a simulation of the ion motion shows that mild acceleration of the ejection process occurs during a forward mass scan (i.e. a scan in which ions are ejected from the trapping region sequentially in the order of increasing mass-to-charge ratio), accomplished by progressively reducing the trapping frequency, for example.

This can be explained by reference to FIG. 3 which shows how the working point W in the (a-q) stability diagram of an ion of given mass-to-charge ratio moves along line a=0 towards a resonance line (in this case $\beta_z=0.5$) as the forward mass scan progresses. As the ion approaches an end cap electrode 2,3 it sees an average DC field created by the voltage applied to the associated field adjusting electrode 4. This DC offset causes an up-shift of the working point to a finite value of the parameter a, closer to the resonance line, thereby abruptly driving the ion into the resonance condition and speeding up its ejection.

Figure 2A:
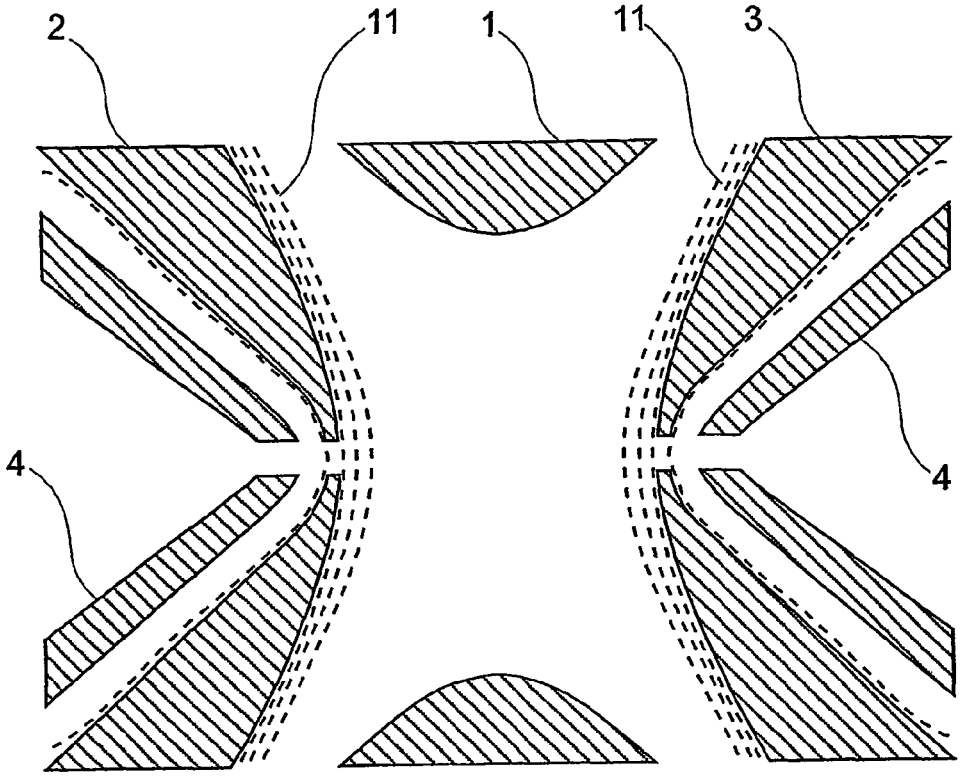
Figure 2B:
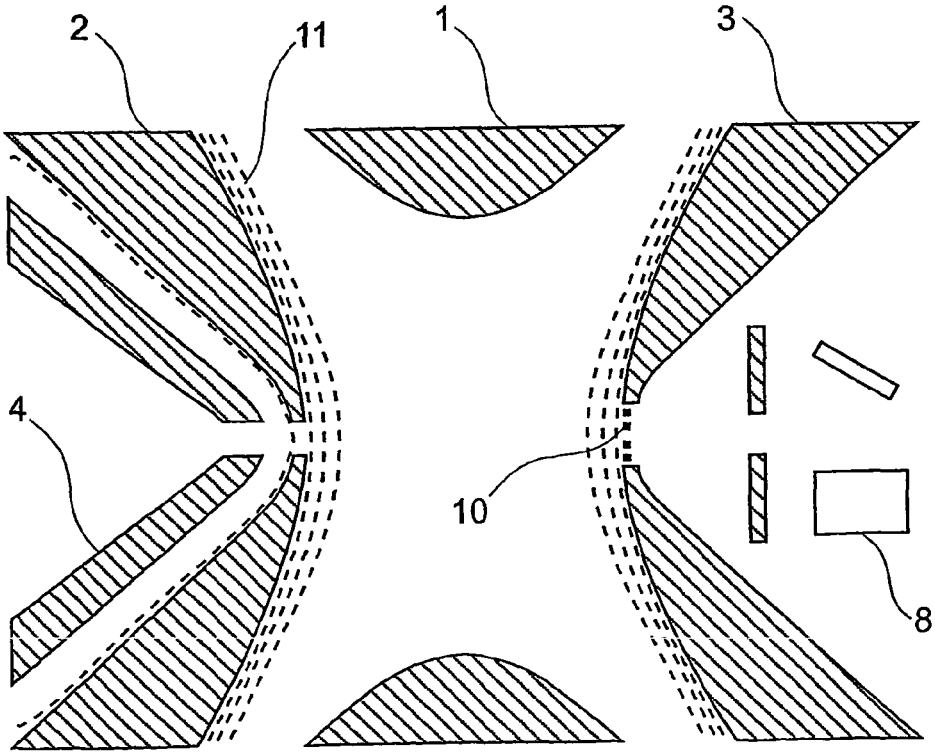
Figure 4A:
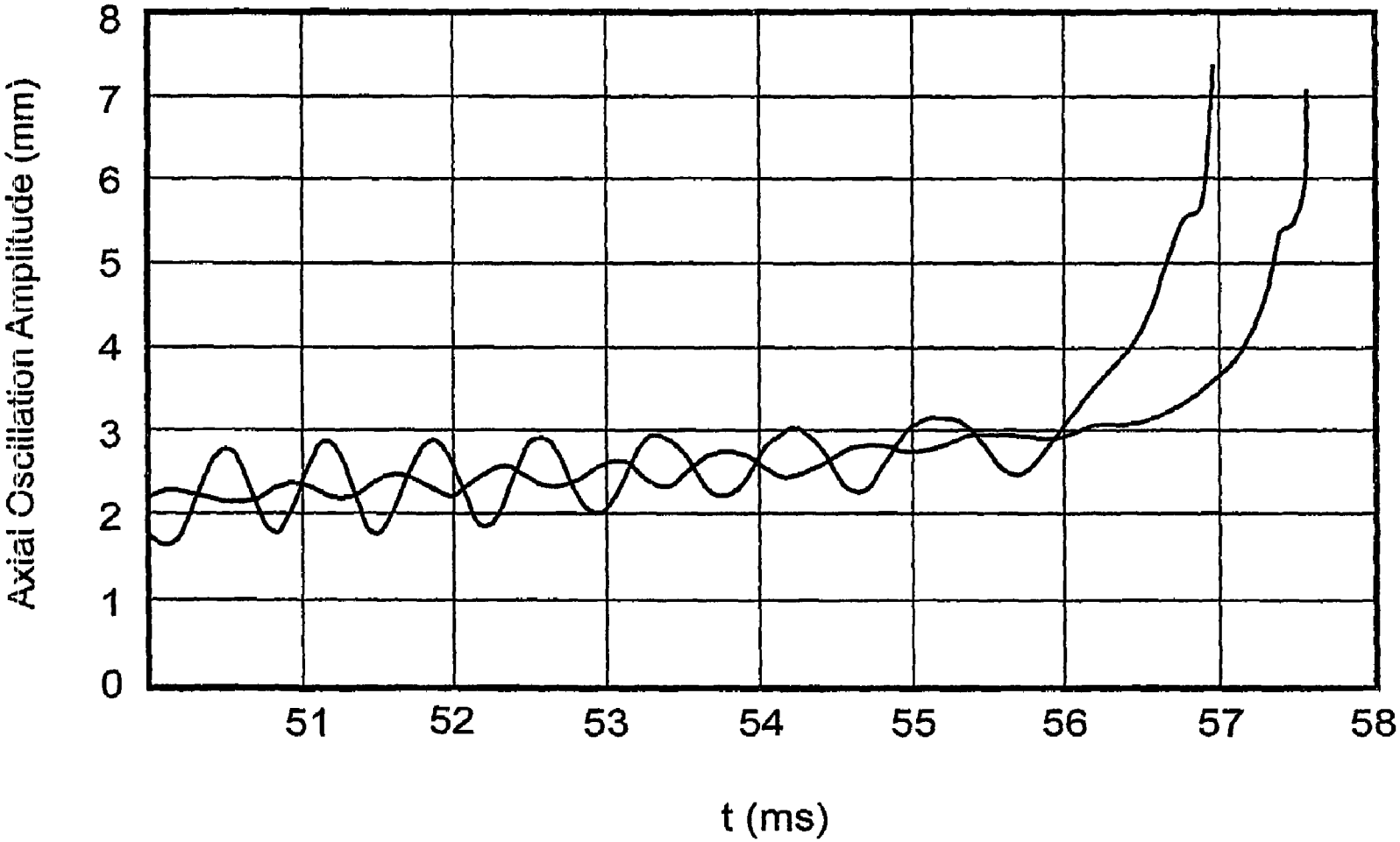
Figure 4B:
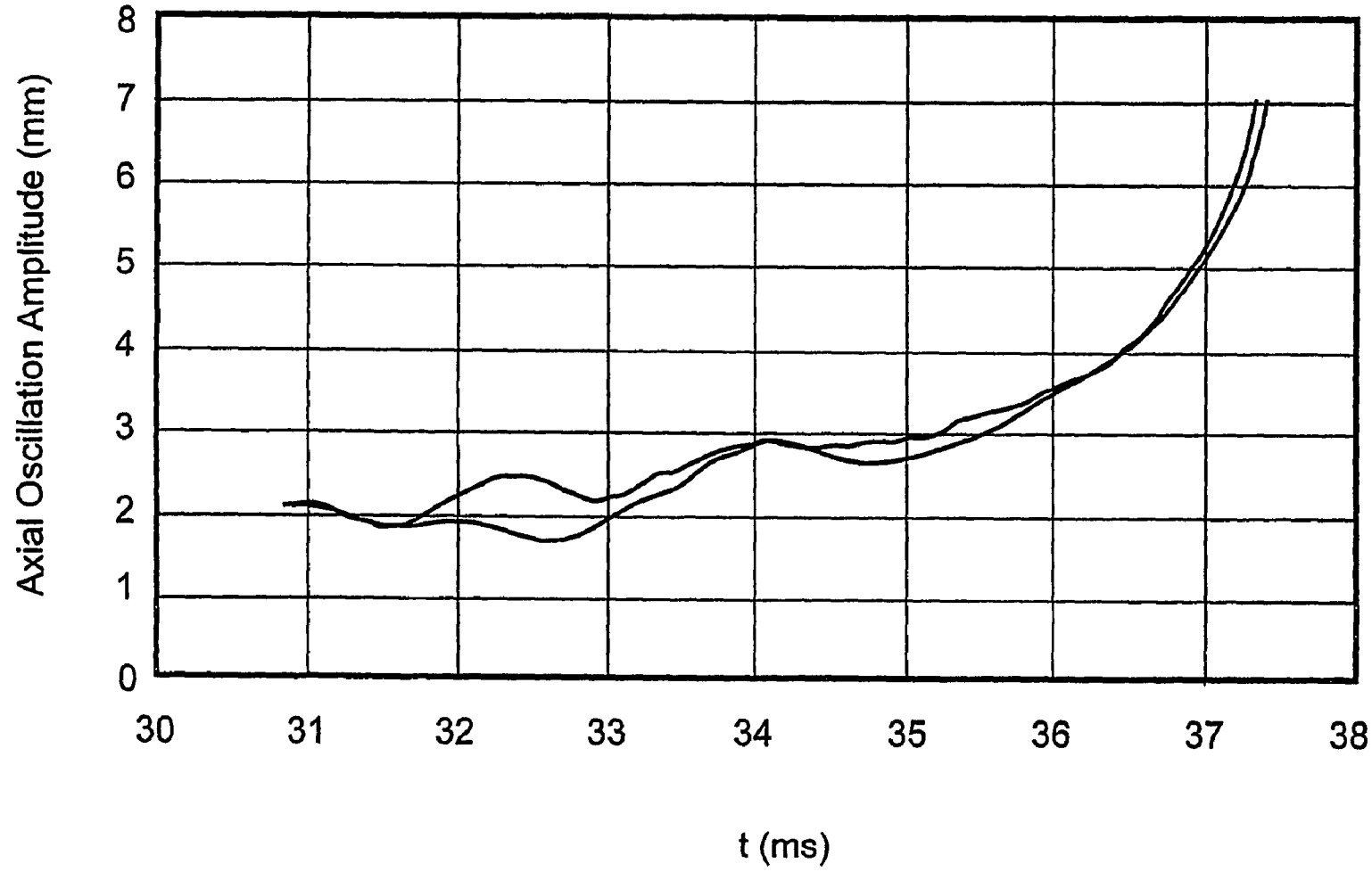

FIGS. 4*a* and 4*b* show simulations of the amplitude of axial excursions of the ions as a function of time as the ions undergo resonance ejection, scan in a stretched geometry ion trap device (FIG. 4*a*) and in the ion trap shown in FIG. 2*b* (FIG. 4*b*). Each illustration shows the amplitude of axial excursions of two ions having the same mass-to-charge ratio (1750 Th) which are randomised by collisions with buffer gas.

FIG. 4*a* show that a strong beat is present in the trajectories produced in the stretched geometry ion trap, and the ejection times will depend upon the phase of this beat which is, of course, a random factor. Growth of the axial excursions of the trajectories shown in FIG. 4*b* is steadier, and the ejection times for the two ions are much closer, although acceleration towards the resonance condition is not as pronounced.

In the case of the ion trap device shown in FIG. 2(*b*), application of a positive DC voltage to the field adjusting electrode adjacent the entrance end cap electrode 2 causes all positive ions to be ejected through the mesh covered aperture in the exit end cap electrode 3 for detection, and this increases the sensitivity of the measurement.

Figure 3:
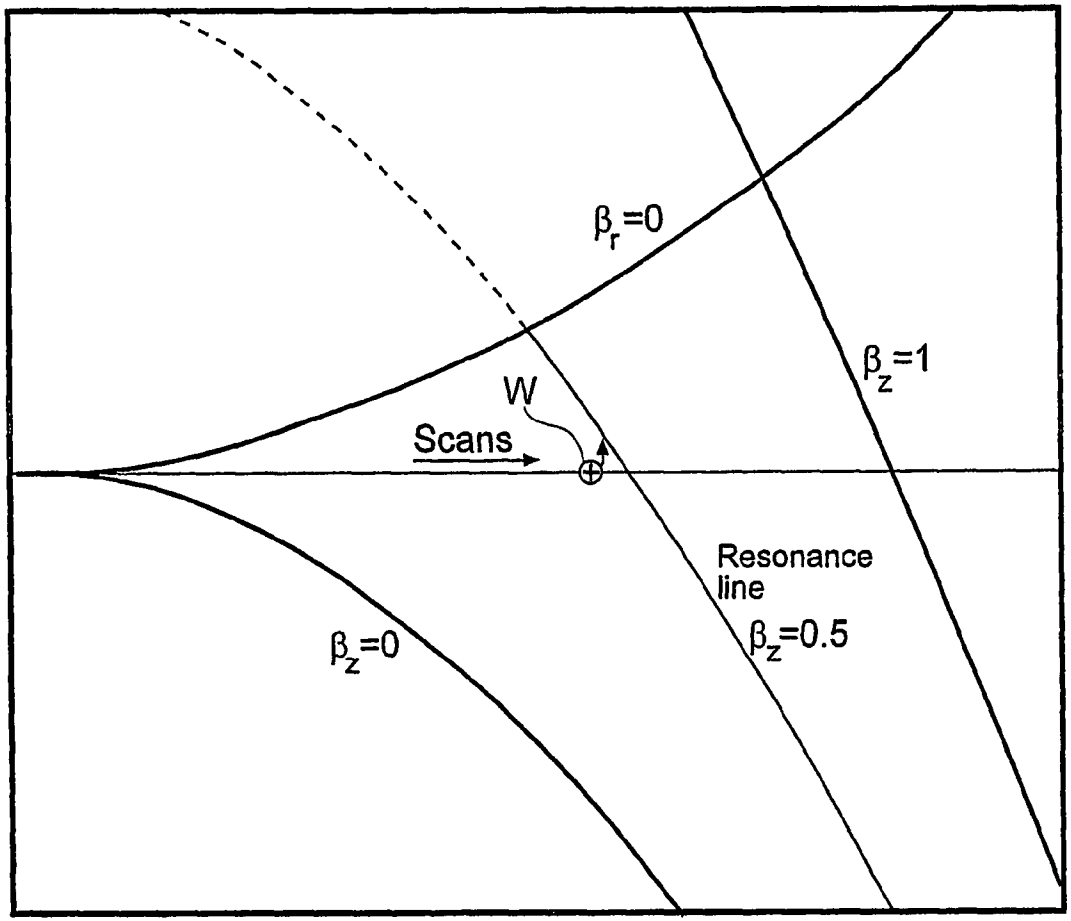
FIG. 3 shows the (a-q) stability diagram obtained for ion motion in a quadrupole electric field produced by a square waveform drive voltage and demonstrates the effect of the field adjusting electrode on secular frequency of ions as they approach a resonance line, FIGS. 4(*a*) and 4(*b*) respectively illustrate the variation of amplitude of ion oscillation as a function time during a scanned resonance ejection (at resonance line $\beta_z$=0.5) obtained using a commercial 'stretched' ion trap device and an ion trap device according to the invention having a field adjusting electrode adjacent the entrance aperture, FIGS. 5(*a*) and 5(*b*) show ranges of mass-to-charge ratio of ions ejected from the trapping region using a single frequency excitation field when the DC voltage applied to the field adjusting electrode is 120V and 1.5 kV respectively, FIGS. 6(*a*) and 6(*b*) show a variation of ion ejection probability as a function of mass-to-charge ratio m/z obtained using respective clipping processes in a notched broad band precursor ion isolation method according to an aspect of the invention.

As explained, a high positive voltage applied to the field adjusting electrode(s) enhances the performance of a forward mass scan, in which the axial secular frequency $\omega_z$ of ions is matched to the excitation frequency $\omega_o$ by shifting the working point of the ions from left to right in FIG. 3 until a resonance line is reached. However, application of a much smaller DC voltage (say, 120 V for example) to the field adjusting electrode(s) 4 can accelerate the ejection of ions during a reverse mass scan (i.e. a scan in which ions are ejected sequentially in order of decreasing mass-to-charge ratio) when the axial secular frequency $\omega_z$ of ions is matched to the excitation frequency $\omega_o$ of the excitation voltage by shifting the working point from right to left in FIG. 3 until a resonance line is reached.

It is impossible in a commercial ion trap device using a positive octapole field to improve mass resolution during forward mass scan, also to achieve high mass resolution during a reverse scan.

However, in the case of the present invention, most of the trapping region is situated in a pure quadrupole electric field in which the trajectories of the ions' oscillations can steadily expand during a resonance ejection scan. During a reverse mass scan, ions will approach the resonance line from the right hand side of the a-q stability diagram, or, in other words, the secular frequency of the ions decreases until it matches the excitation frequency $\omega_o$. The ions see the negative high order multipole field at the aperture because the positive compensating field produced by the field adjusting electrode 4 is relatively small. This negative high order field leads to a decrease of secular frequency, abruptly driving the ion towards the resonance condition and speeding up its ejection.

Above, we have shown that good mass scan performance can be achieved by controlling the voltage applied to the field adjusting electrode(s). We now present some simulation results showing ejection probability at given resonant ejection conditions, and we discuss different methods for precursor ion isolation.

For a given trapping field, a single excitation frequency should, according to theory, cause ejection of ions having a single mass-to-charge ratio. However, in practice, there is a finite probability that ions having higher and lower mass-to-charge ratios will also be ejected, reducing the mass resolution of the resonance ejection process. However, application of high and low DC voltages to the field adjusting electrode(s) can significantly improve the mass resolution of this process.

Figure 5A:
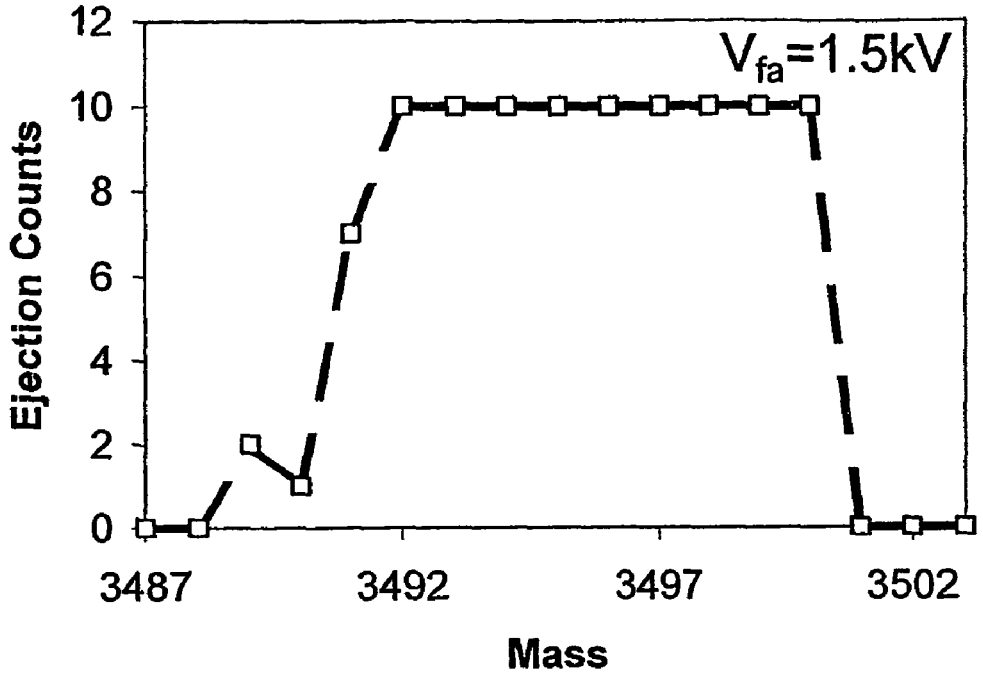
Figure 5B:
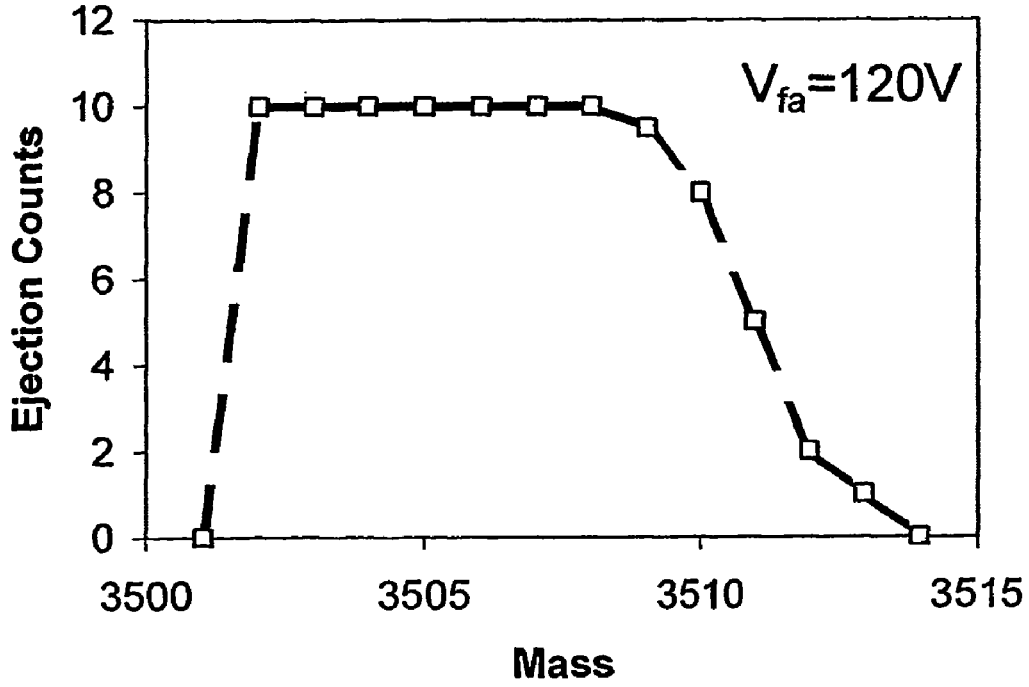

FIGS. 5*a* and 5*b* show mass ejection bands obtained, by simulation, using a single excitation frequency and fixed trapping parameters. In these simulations ten ions were used for each mass-to-charge ratio and all ions were excited using the same dipole excitation field. These figures respectively illustrate the effect of applying a low DC voltage ($V_{fa}$=120V) and a high DC voltage ($V_{fa}$=1.5V) to the field adjusting electrode(s).

The effect of applying the low DC voltage to the field adjusting electrode(s) is to create a steep clipping edge on the low mass side of the resultant ejection band, whereas the effect of applying the high DC voltage to the field adjusting electrode(s) is to create a steep clipping edge on the high mass side of the resultant ejection band.

These steep clipping edges can be exploited to improve resolution of precursor ion isolation, and this simulation shows that it is possible to isolate precursor ions having a single mass-to-charge ratio (3500 in this example), as will be explained.

To this end, the afore-mentioned forward and reverse mass scans can be combined to isolate, with high resolution, precursor ions having a single (or small range of) mass-to-charge ratio. In this application, the forward mass scan is carried out to eject ions having mass-to-charge ratios smaller than that of the selected precursor ions, and the reverse mass scan is then carried out to eject ions having mass-to-charge ratios larger than that of the selected precursor ions. Both scans would stop just short of the mass-to-charge ratio of the selected precursor ions. The order of the two scans can be interchanged, but for each scan the voltage ($V_{fa}$) on the field adjusting electrodes is set at the appropriate value (i.e. a high value for the forward mass scan and a much smaller value for the reverse mass scan) in order to create the afore-mentioned steep clipping edges on the high and low mass sides respectively of their respective mass ejection bands. This process enables the mass-to-charge ratio of the isolated precursor ions to be defined with high mass resolution.

Between the forward and reverse mass scans the ions remaining in the trapping region are subjected to a cooling process.

It is also very common to use a notched broad band excitation signal, applied between the end cap electrodes, to excite ions to effect precursor ion isolation.

For a fixed trapping field, ions having mass-to-charge ratios corresponding to the excitation frequencies of the broadband excitation field will be resonantly excited and thereby ejected from the trapping region including those hitting the end cap electrodes.

In the notch, where excitation frequencies are absent, ions having corresponding mass-to-charge ratios will be retained.

The notch in the excitation signal is defined by upper and lower frequency limits, respectively corresponding to lower and upper mass limits of a range of mass-to-charge ratio. The current invention offers the possibility to sharply cut away unwanted ions from both the low and the high mass sides of this mass range. To this end, $V_{fa}$ should be set at a value such that the secular frequency shift which occurs as ions approach the apertures of the electrodes is minimised. In this example, $V_{fa}$=1.3 kV, giving good conditions for ejection of unwanted ions on both sides of the precursor ion mass range that is to be isolated. However, a two stage clipping method is expected to give even better resolution.

The frequency notch in the frequency spectrum of the notched broadband excitation signal corresponds to a range of a mass-to-charge ratio.

In a first stage of the two stage clipping method, $V_{fa}$ is set at 120V, creating a sharp clipping edge on the high mass side of the mass range, and so defining an upper mass limit. The selected mass-to-charge ratio is set just below the upper mass limit so that substantially all ions having mass-to-charge ratios greater than the selected mass-to-charge ratio are ejected from the trapping region. This is the equivalent to setting the secular frequency of the precursor ions just above the lower frequency limit of the frequency notch.

In a second stage of the clipping method, $V_{fa}$ is set at 1.5 kV creating a sharp clipping edge on the low mass side of the mass range, and so defining a lower mass limit. The selected mass to charge ratio is set just above the lower mass limit so that substantially all ions having mass-to-charge ratios less than the selected mass-to-charge ratio are ejected from the trapping region. This is equivalent to setting the secular frequency of the precursor ions just below the upper frequency limit of the frequency notch.

The mass range of ions remaining within the trapping region at the conclusion of the two stage clipping process will be determined by the closeness of the selected mass-to-charge ratio to the upper and lower mass limits in the two clipping stages, but not the width of the notch. The described process enables precursor ions having a single mass-to-charge ratio to be isolated.

Figure 6A:
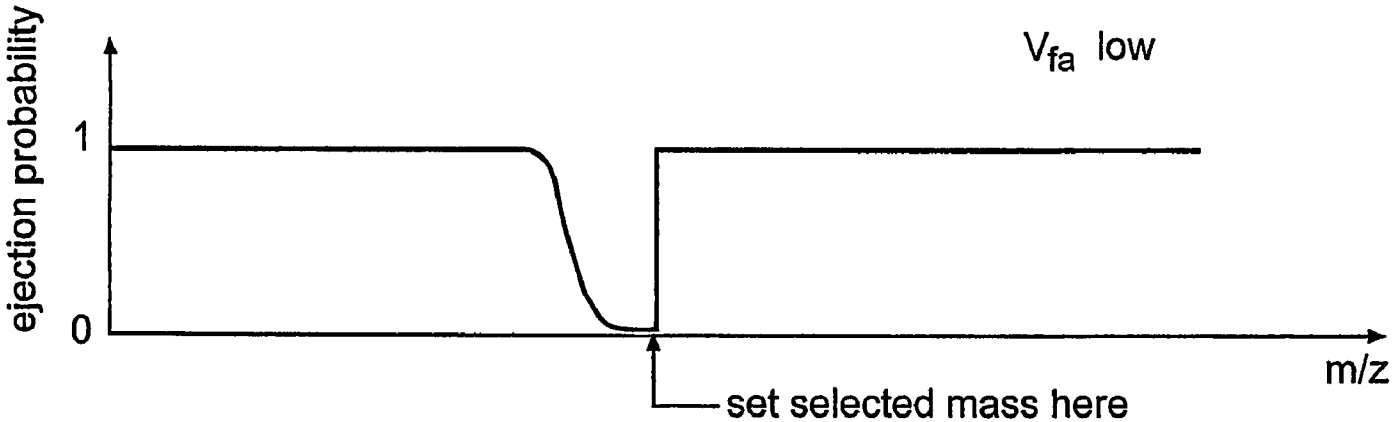
Figure 6B:
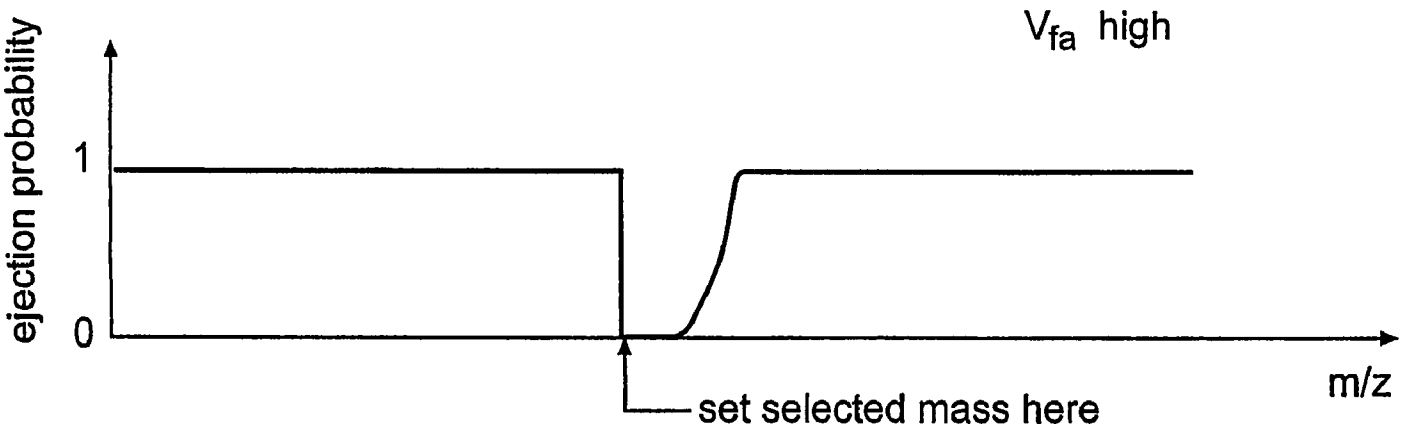

FIGS. 6*a* and 6*b* illustrate ejection probability as a function of mass-to-charge ratio m/z obtained by the respective stages of this clipping method.

The position of the upper and lower mass limits can be set relative to the selected mass-to-charge ratio by controllably adjusting the trapping electric field (by adjusting the frequency and/or amplitude of the drive voltage) or by controllably shifting the position of the frequency notch within the frequency spectrum of the broadband excitation signal.

The order of the first and second stages of the two stage clipping process can be reversed so that the low mass side of the isolated mass range is clipped before the high mass side.

Between the two stages, the ions remaining in the trapping region are subjected to a cooling process.

Figure 7:
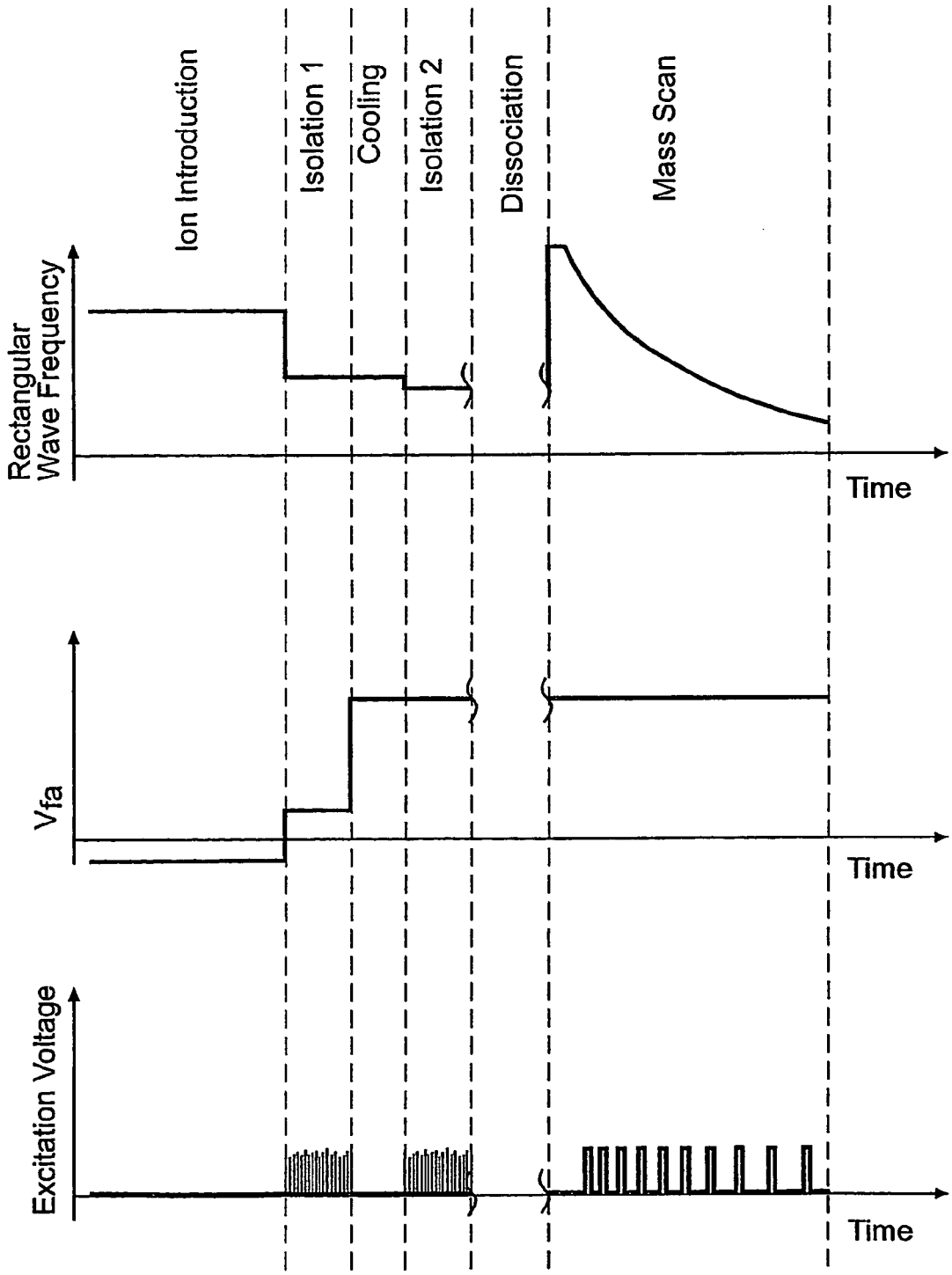
FIG. 7 is an example of an operating program for a tandem MS showing how rectangular waveform frequency, field adjusting voltage and excitation voltage vary as a function of time during ion introduction, precursor ion isolation and mass scanning processes.

FIG. 7 illustrates an example of precursor ion isolation using the two-stage, notched broadband frequency clipping process. This Figure also illustrates ion introduction and mass scanning.

One more aspect of using a voltage controllable field adjusting electrode is to improve the efficiency with which ions are introduced into an ion trap employing an external ion source. In principle, ions generated outside the quadrupole ion trap cannot be trapped if the ion trap is driven by a fixed, periodically changing AC voltage. This can be explained, by observing that the energy of an ion which is able to enter the trapping region must be higher than the depth of the pseudo potential well and so it must have a high kinetic energy, i.e. enough energy to escape from the ion trap or to hit an internal surface of the ion trap. Damping gas, normally helium or nitrogen, is used to remove the kinetic energy of the injected ions by collisons. This improves the chances that the ions will be trapped. However removal of sufficient energy within one secular swing, so that ions will not collide with the surface of an electrode is less probable. So the trapping efficiency is normally very low.

Now, by using a field adjusting electrode at the entrance aperture and applying it to a negative voltage, the potential well during a certain phase of the trapping field may be modified to look like a well with a narrow notch on its edge. An ion entering the well may carry substantially the same or less energy than the depth of the well and it takes a relatively long time for the ion to find the notch again and escape, so there is greater probability that the kinetic energy of the ion will have been reduced and that the ion will be permanently trapped. Because $V_{fa}$ is adjustable, it can be tuned to trap ions with different initial parameters such as mass-to-charge ratio and energy during the introduction period.

Figure 8:
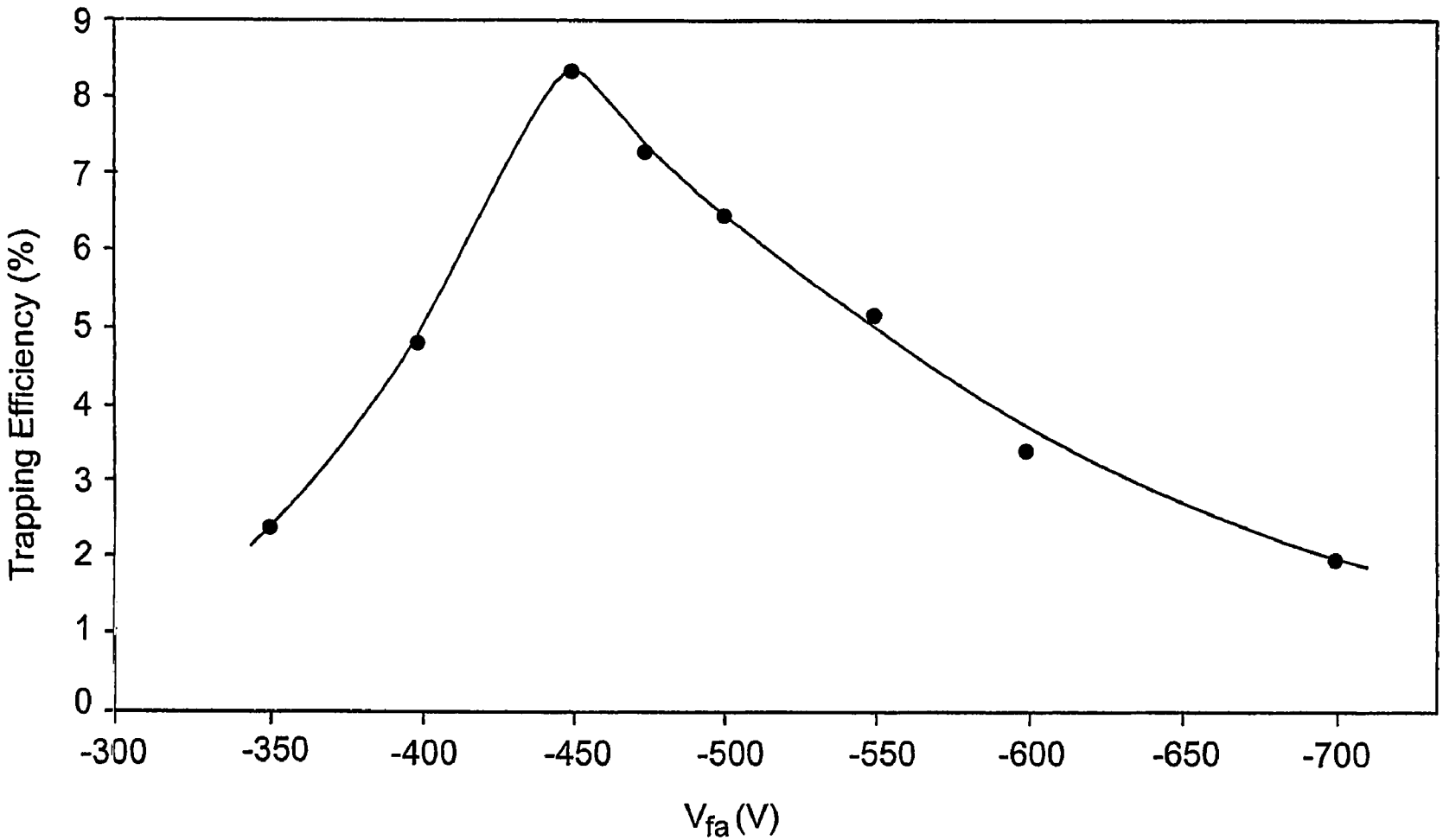
FIG. 8 is a simulation showing how efficiency of ion introduction varies as a function of voltage $V_{fa}$ applied to the field adjusting electrode.

FIG. 8 shows the trapping efficiency, obtained by simulation, during ion introduction. In this simulation, ion mass was 6000 Da, the initial kinetic energy of the ions was 15 eV staring from a lens system held at an electrical potential of −20V. The ion beam had a Gaussian radial distribution, with $\sigma$=0.1 mm. The ions underwent random collision with He buffer gas and the mean free path was assumed to be 5 mm.

If the mass range of trapping is not a priority, it is suggested to use a certain DC component in the trapping field ($a \neq 0$). In such cases, the radial secular frequency will differ from the half frequency of the axial secular oscillations, so it is harder for ion to return to the entrance aperture.

The voltage on the field adjusting electrode(s) can be supplied by a voltage controllable DC power supply. The means to control the voltage can be either switching means or a linear control means such as a feedback loop. The output should have at least three selectively switchable voltage levels to accommodate introduction, ion isolation (which requires two levels) and mass scanning.

The field adjusting electrode 4 should be placed close enough to an end cap aperture (a distance from the aperture less than or equal to the diameter of the aperture) to ensure that the electrode has a sufficient influence in the aperture region inside the trap. Although in the illustrated embodiments the electrode has a solid structure with an aperture aligned with the entrance aperture of the end cap electrode, it can also be formed as a metal grid or may be made of solid metal but with a mesh covering its aperture.

When two field adjusting electrodes are used to compensate for the field distortion due to both end cap electrode apertures, as shown in FIG. 2*a*, mass resolution for precursor ion selection can be improved without the complication of a mesh structure. However, ions may not be successfully ejected through the end cap aperture because the required voltage on the field adjusting electrode for multiple field correction always retards the ions. Therefore, the structure of FIG. 2*a* is not suitable for mass analysis in the resonant ejection scan mode, but it may be favourable when the ion trap is used as an ion selection means in technology such as an ion-trap-ToF tandem MS application. It can also be used for mass analysis by detecting image current induced by the secular motion of ions.

The foregoing embodiments have been described with reference to positively charged ions. In the case of negatively charged ions, field adjusting electrode(s) would be supplied with DC voltages having the opposite polarities.

The invention also relates to a mass spectrometer comprising the combination of an ion source, such as an electrospray ion source having the necessary high pressure-to-vacuum interface, an ion trap device, in accordance with the invention, as described in any of the foregoing embodiments and ion optics to guide and focus ions from the ion source into the ion trap device. To detect ions ejected from the ion trap device a detector in the form of a conventional electron multiplier having a conversion dynode can be used. Alternatively, a multi-channel plate (MCP) or a cryogenic detector for ions of very high mass could be used.

A mass spectrometer may use the field-adjustable ion trap device as a store and precursor ion selection tool, and may include a ToF to achieve fast and accurate mass analysis. In this case, ions are firstly introduced with high efficiency to the ion trap device where high resolution precursor selection can be carried out. The isolated precursor ions can then be excited and made to collide with neutral gas molecules or with an ion trap electrode to cause dissociation (CID and SID) of the precursor ions. The resultant product ions are finally ejected into the ToF analyser by applying pulsed voltage between the two end cap electrodes. Because the final mass validation is obtained by using ToF, control of the voltage of field adjusting electrode to keep high mass scan resolution is not used. Instead, when using pulsed ejection, the voltage on the field adjusting electrode near the exit end cap electrode should be set at a potential for making ejection easier and for enabling a better ion beam to be formed for introduction into the ToF. In this case it is preferable to use, a negative voltage for ejection of positive ions and a positive voltage for the ejection of negative ions.

The invention claimed is:

1. A quadrupole ion trap device comprising, an electrode structure having a ring electrode and two end cap electrodes enclosing a trapping region, one said end cap electrode being an entrance end cap electrode having a central aperture through which ions can enter the trapping region, a field adjusting electrode located outside the trapping region adjacent to the aperture of said entrance end cap electrode, AC power supply means arranged to supply AC voltage to said electrode structure to create within the trapping region a trapping electric field for trapping ions and an excitation electric field for resonantly exciting ions trapped by the trapping electric field, and DC power supply means arranged to supply to said field adjusting electrode, and controllably vary, DC voltage whereby selectively to influence ion motion in the trapping region according to an operating mode of the ion trap device.

2. A device as claim 1 including a further field adjusting electrode located outside the trapping region adjacent to the aperture of another said end cap electrode being an exit end cap electrode, and wherein said DC power supply means is arranged to supply DC voltage to said further field adjusting electrode and to controllably vary the supplied voltage to influence ion motion near the aperture of said exit end cap electrode.

3. A device as claimed in claim 1 wherein the aperture of another said end cap electrode being an exit end cap electrode is adapted to minimise influence of that aperture on the shape of equipotential field surface inside the trapping region.

4. A device as claim 3 wherein the aperture of said exit end cap electrode has an ion transmissive, electrically conductive covering.

5. A device as claim 4 wherein said covering is a metal mesh.

6. A device as claim 3 wherein the aperture of the exit end cap electrode is smaller than the aperture of the entrance end cap electrode.

7. A device as claimed in claim 1 wherein said DC power supply means supplies to said field adjusting electrode DC voltage controllably selectable from a plurality of different voltage levels according to the operational mode of the device.

8. A device as claim 7 wherein said DC voltage is controllably selectable from three said voltage levels, a first said voltage level being selected while ions are being introduced into the trapping region, a second said voltage level being selected while ions are being ejected from the trapping region, for analysis, during a mass scanning mode of operation, and said second and third said voltage levels being selected during a precursor ion isolation mode of operation.

9. A device as claimed in claim 1 wherein said ring electrode and said end cap electrodes have a hyperboloid geometry.

10. A device as claimed in claim 1 wherein said AC power supply means includes a RF voltage source for supplying drive voltage to the ring electrode wherein the frequency and/or amplitude of the drive voltage supplied to the ring electrode can be scanned across a predetermined range to reasonably excite, and eject from the trapping region, ions selected sequentially in the order of their mass-to-charge ratios.

11. A device as claimed in claim 1 wherein said AC power supply means includes switching means for supplying a rectangular waveform drive voltage to the ring electrode wherein a parameter defining said rectangular waveform drive voltage can be scanned across a predetermined range to resonantly excite, and eject from the trapping region, ions selected sequentially in the order of their mass-to-charge ratios.

12. A device as claim 11 wherein said switching means is a digitally controllable switching means.

13. A device as claimed in claim 1 wherein said DC power supply means is arranged to scale said DC voltage in proportion to the trapping voltage supplied to the ring electrode.

14. A method for using an ion trapping device as claimed in claim 1 to isolate precusor ions having a selected mass-to-charge ratio, the method comprising the steps of performing two mass scanning procedures, one said mass scanning procedure being effective to resonantly excite, and thereby remove from the trapping region, ions sequentially in the order of increasing mass-to-charge ratio up to and including a mass-to-charge ratio less than said selected mass-to-charge ratio, and another said mass scanning procedure being effective to resonantly excite, and thereby remove from the trapping region, ions sequentially in the order of decreasing mass-to-charge ratio down to and including a mass-to-charge ratio greater than said selected mass-to-charge ratio, setting the DC voltage supplied to said field adjusting electrode at a first voltage level while said one mass scanning procedure is being carried out and setting the DC voltage at a second voltage level, having a magnitude less than that of said first voltage level, while said another mass scanning procedure is being carried out, and cooling ions that remain in the trapping region between performance of said one and another mass scanning procedures.

15. A method as claimed in claim 14 wherein said AC power supply means supplies a rectangular waveform drive voltage to said ring electrode to create said trapping electric field, and said one and another mass scanning procedures are carried out by scanning a parameter of the rectangular waveform drive voltage across different respective ranges.

16. A method of using an ion trapping device as claimed in claim 1 to isolate precursor ions having a selected mass-to-charge ratio, the method including, creating a notched broadband excitation electric field having a frequency notch corresponding to a range of mass-to-charge ratio, performing a two-stage clipping method, one said stage of the clipping method including setting the voltage applied to said field adjusting electrode at a first voltage level to create a clipping edge on the low mass side of said mass range defining a lower mass limit and setting said selected mass-to-charge ratio close to said low mass limit, and another said stage of the clipping method including setting the voltage applied to said field adjusting electrode at a second voltage level, having a magnitude less than said first voltage level, to create a clipping edge on the high mass side of said mass range defining an upper mass limit and setting said selected mass-to-charge ratio close to said upper mass limit, and cooling ions that remain in the trapping region between performance of the two clipping method.

17. A method as claimed in claim 16 wherein said one said stage of the clipping method is effective to eject substantially all ions having mass-to-charge ratios less than said selected mass-to-charge ratio and said another said stage of the clipping method is effective to eject substantially all ions having mass-to-charge ratios greater than said selected mass-to-charge ratio so that at the conclusion of said one and another clipping methods the only ions remaining with the trapping region are ions having said selected mass-to-charge ratio.

18. A method as claimed in claim 16 wherein a position of said selected mass-to-charge ratio relative to said upper and lower mass limits is set by controllably adjusting the trapping electric field.

19. A method as claimed in claim 16 wherein a position of said selected mass-to-charge ratio relative to said upper and lower limits is set by controllably shifting the position of said frequency notch whereby to shift said range of mass-to-charge ratio relative to said selected mass-to-charge ratio.

20. A method for using an ion trapping device as claim 1 to isolate precursor ions having a selected mass-to-charge ratio, the method including:

creating a notched broadband excitation electric field having a frequency notch defined by upper and lower frequency limits, performing two mass clipping processes, one said mass clipping process including setting the DC voltage applied to said field adjusting electrode at a first voltage level and setting the secular frequency of the precursor ions closer to the upper frequency limit than the lower frequency limit, and another said mass clipping process including setting the DC voltage applied to said field adjusting electrode at a second voltage level; having a magnitude less than that of said first voltage level and setting the secular frequency of the precursor ions closer to the lower frequency limit than the upper frequency limit, and cooling the ions that remain in the trapping region between performance of the two mass clipping processes.

21. A mass spectrometer comprising an ion source, a quadrupole ion trap device as claimed in claim 1, ion optics for guiding and focussing ions from the ion source into the ion trap device, and means for detecting ions ejected from the ion trap device.

22. A mass spectrometer comprising an ion source, a quadrupole ion trap device as claimed in claim 1, ion optics for guiding and focussing ions from the ion source into the ion trap device and time-of-flight means for analysing ions ejected from the ion trap device.

23. A method of operating a quadrupole ion trap device including a ring electrode, and two end cap electrodes enclosing a trapping region, one of said end cap electrodes being an entrance end cap electrode having a central aperture through which ions can enter the trapping region, and a field adjusting electrode located outside the trapping region adjacent to the aperture of said entrance end cap electrode, the method including, generating a trapping electric field within the trapping region, generating an excitation electric field within the trapping region for resonantly exciting ions trapped by the trapping electric field, applying DC voltage to said field adjusting electrode to influence ion motion near the entrance aperture, and selectively controlling the applied DC voltage to improve efficiency with which ions enter the trapping region through said entrance aperture and to enhance resolution of mass isolation carried out on the trapped ions.

24. A method as claimed in claim 23 including selectively controlling the applied DC voltage to enhance resolution of a mass-selective scanning process carried out on the trapped ions.

25. A method as claimed in claim 24 wherein said mass-selective scanning process includes precursor ion selection and/or ejection from the trapping region, for analysis, of ions sequentially in the order of their mass-to-charge ratios.

26. A method as claimed in any one of claims 23 to 25 wherein the applied DC voltage compensates for a reduction of ion secular frequency caused by high order multipole fields near the entrance end cap electrode.

27. A method as claimed in any one of claims 23 to 25 wherein the applied DC voltage causes an increase of ion secular frequency as the axial excusions of the trajectories of the ions approach the entrance aperture within the trapping region.

28. A method as claimed in any one of claims 23 to 25 wherein said trapping electric field is generated by supplying RE voltage to said ring electrode, and said DC voltage is scaled to be in proportion to the amplitude of the RF voltage during a said mass-selective scanning process.

29. A method as claimed in claim 23 wherein the DC voltage applied to said field adjusting electrode is set to have a polarity opposite to that of the ions to be trapped and at such a level as to assist entry of the ions into the trapping region through the aperture of the entrance end cap.

30. A method as claimed in claim 29 including providing a DC component in the trapping electric field to inhibit ions introduced into the trapping region from immediately returning to the entrance aperture.

* * * * *

UNITED STATES PATENT AND TRADEMARK OFFICE

CERTIFICATE OF CORRECTION

PATENT NO. : 7,285,773 B2
APPLICATION NO. : 10/494493
DATED : October 23, 2007
INVENTOR(S) : Ding et al.

It is certified that error appears in the above-identified patent and that said Letters Patent is hereby corrected as shown below:

At column 11, line 1, please correct “reasonably” to read --resonantly--.

At column 14, line 6, please correct “RE” to read --RF--.

Signed and Sealed this

Eighth Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 7,285,773 B2
APPLICATION NO. : 10/494493
DATED : October 23, 2007
INVENTOR(S) : Ding et al.

It is certified that error appears in the above-identified patent and that said Letters Patent is hereby corrected as shown below:

Title Page, Item (73) Assignee, should read:
"SHIMADZU RESEARCH LABORATORY (EUROPE) LIMITED".

Signed and Sealed this

Twenty-third Day of December, 2008

JON W. DUDAS
*Director of the United States Patent and Trademark Office*